US006859136B2

(12) United States Patent
Gastel

(10) Patent No.: US 6,859,136 B2
(45) Date of Patent: Feb. 22, 2005

(54) DEVICE FOR ALERTING USERS OF MEDICINE

(76) Inventor: Robert Gastel, 6705 N. 35th, McAllen, TX (US) 78504-5839

( * ) Notice: Subject to any disclaimer, the term of this patent is extended or adjusted under 35 U.S.C. 154(b) by 45 days.

(21) Appl. No.: 10/162,496

(22) Filed: Jun. 5, 2002

(65) Prior Publication Data

US 2003/0227371 A1 Dec. 11, 2003

(51) Int. Cl.[7] ..... G08B 1/00
(52) U.S. Cl. ..... 340/309.7; 340/309.4; 368/10
(58) Field of Search ..... 340/309.4, 309.7, 340/309.16, 309.5; 368/10; 702/177; 40/311; 434/365; 177/25.14

(56) References Cited

U.S. PATENT DOCUMENTS 4,419,016 A * 12/1983 Zoltan ..... 368/10
4,490,711 A * 12/1984 Johnston ..... 340/309.4
4,617,557 A * 10/1986 Gordon ..... 340/309.7
4,682,299 A * 7/1987 McIntosh et al. ..... 702/177
5,014,798 A * 5/1991 Glynn ..... 177/25.19
5,239,491 A * 8/1993 Mucciacciaro ..... 702/177
5,577,335 A * 11/1996 Tucker ..... 40/311
5,751,661 A * 5/1998 Walters ..... 368/10
5,846,089 A * 12/1998 Weiss et al. ..... 434/365
5,852,590 A * 12/1998 de la Huerga ..... 368/10
5,931,302 A * 8/1999 Isaacs et al. ..... 206/538
6,198,383 B1 * 3/2001 Sekura et al. ..... 340/309.4

* cited by examiner

*Primary Examiner*—Benjamin C. Lee

(57) ABSTRACT

The present invention addresses the persistent problems encountered when a medicine is prescribed to be used at specific intervals. A device explicitly designed to function in conjunction with a designated container of medicine emits signals. This in turn, serves as a reminder of the exact times established.

2 Claims, 3 Drawing Sheets

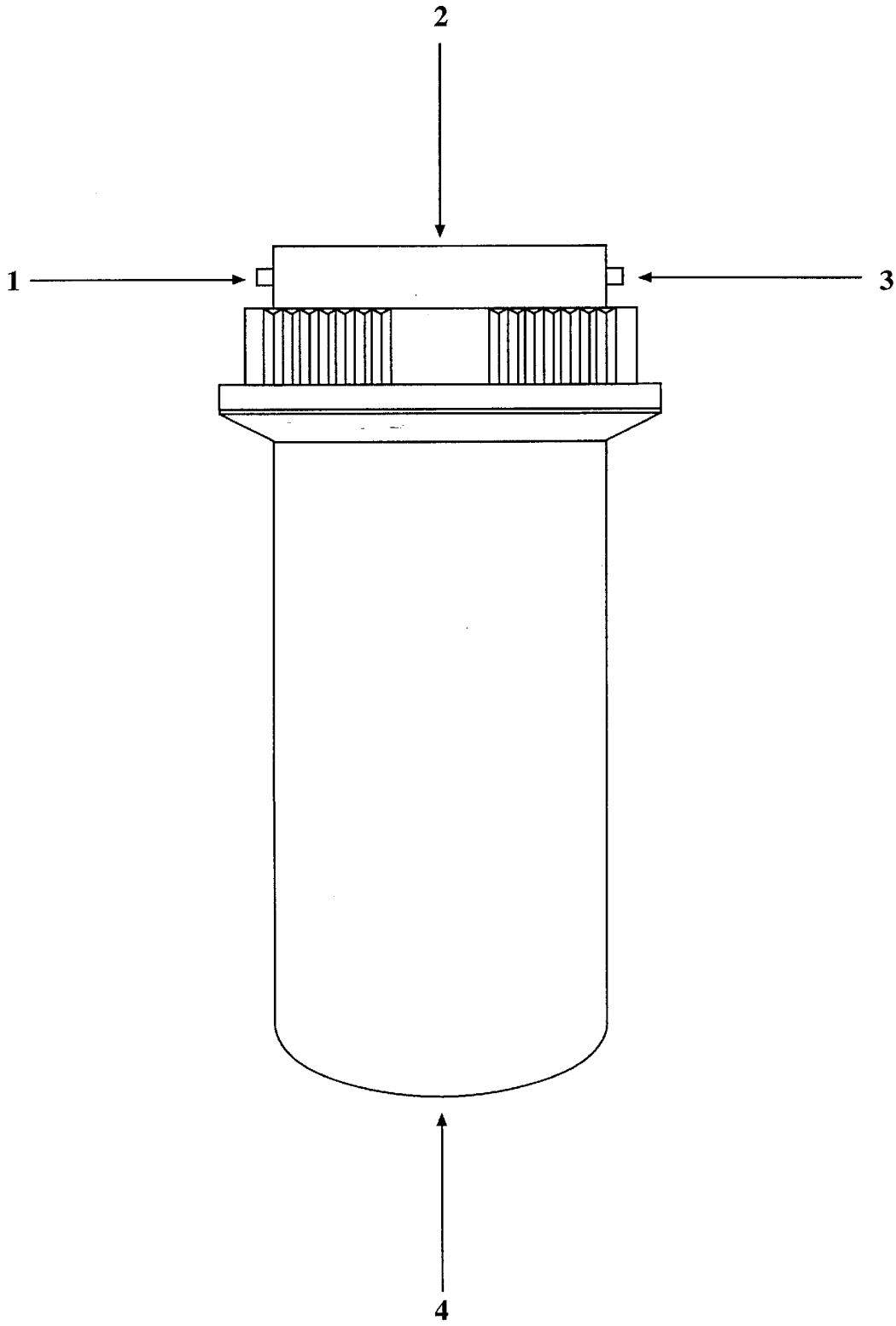
FIGURE (1)

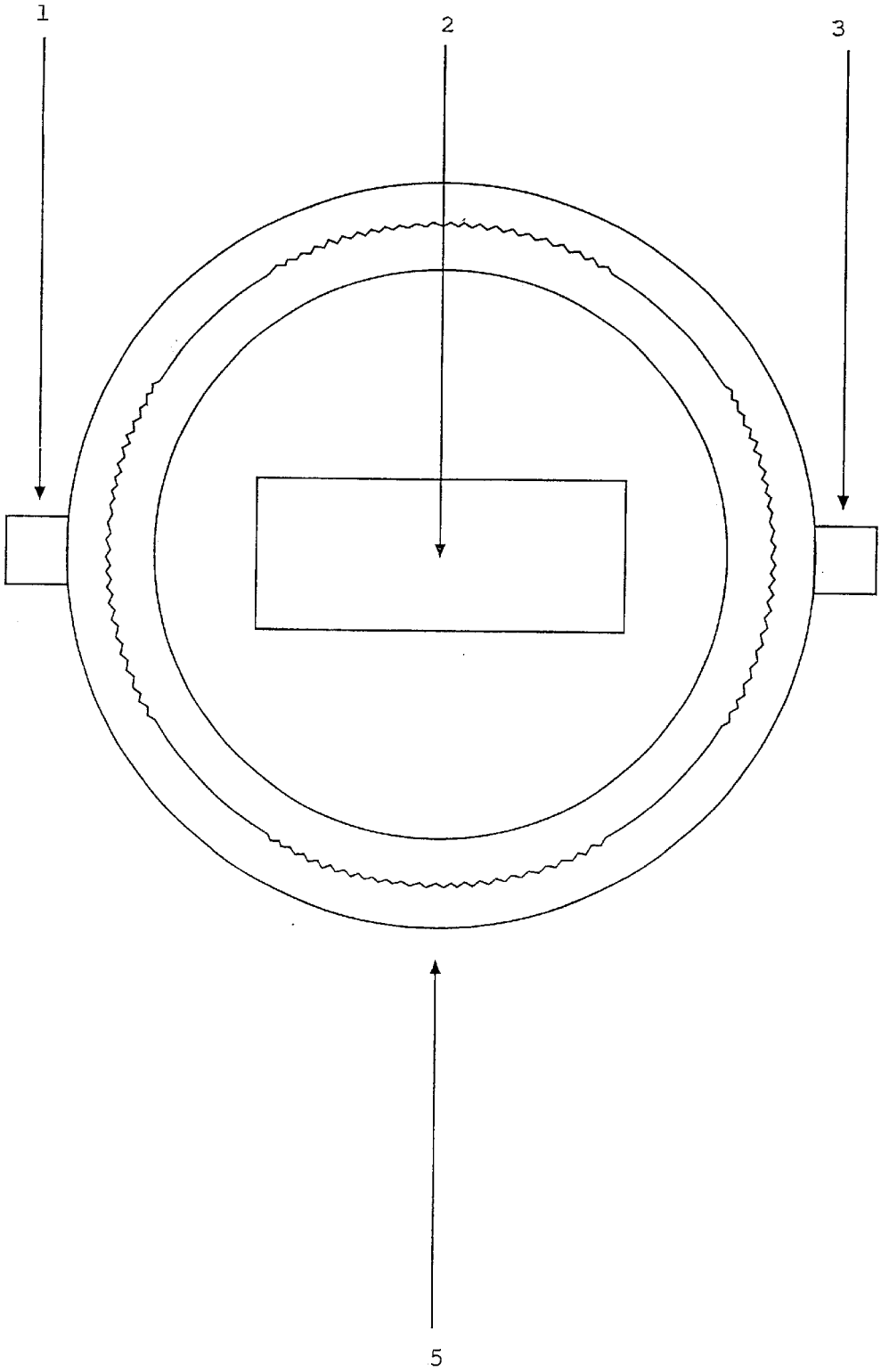
FIGURE (2)

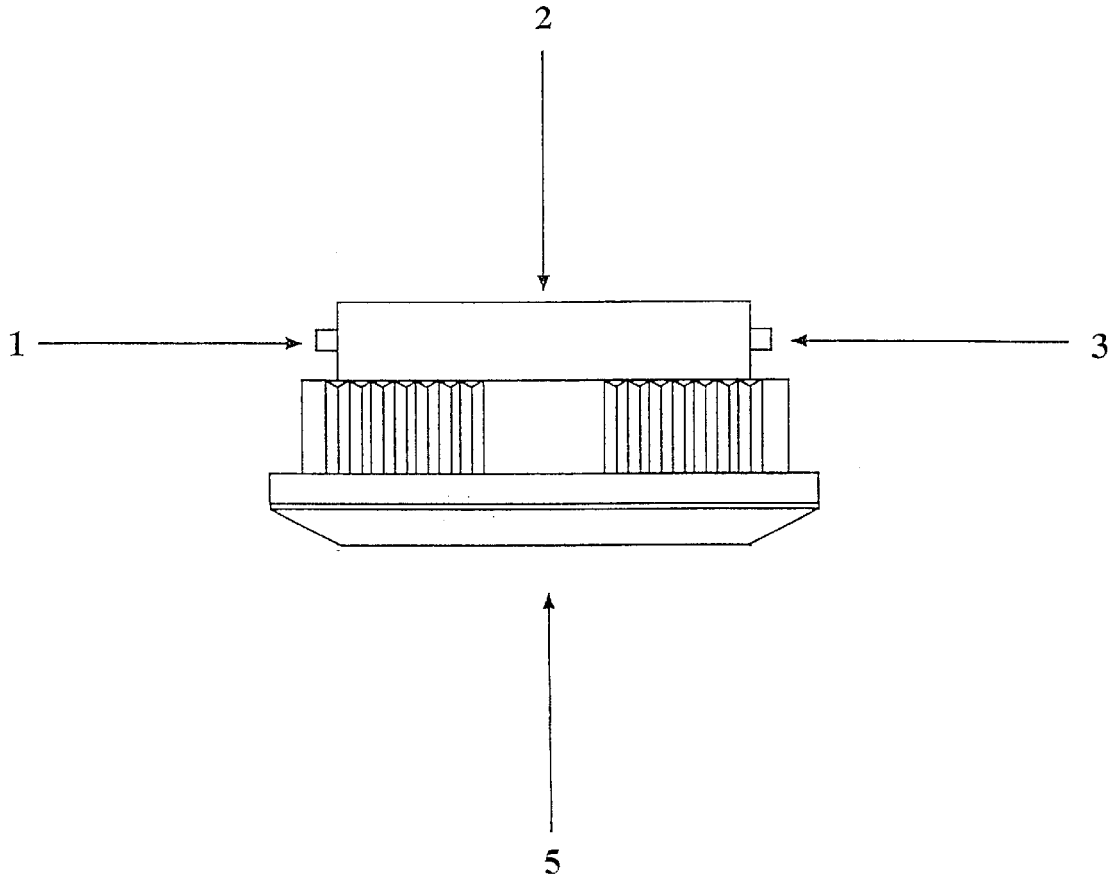
FIGURE (3)

DEVICE FOR ALERTING USERS OF MEDICINE

FIELD OF THE INVENTION

This invention addresses the age-old, widespread problems encountered when time periods have been prescribed relative to the use of a particular medicine. The haphazard ways of determining these critically important times have resulted in many cases, serious consequences.

BACKGROUND OF THE INVENTION

The extreme importance of using medicines as prescribed can not be questioned. When a particular medicine has been prescribed to be taken at specific intervals, certain problems arise. How can the patient or attendant be reminded of the time periods established? For example, once daily, twice daily, and three times daily. In the vast majority of the situations there are no practical, definitive answers. It appears that a cloud of doubt hangs over the entire period of time during which a medicine is scheculed to be used. Oftentimes, a particular time period is missed or the medicine is taken later than scheduled. It may necessitate the alteration of the prescribed schedule. It is the purpose of this invention to help in alleviating these problems.

It is recognized and acknowledged that there are numerous permanent-type timers on the market that send out signals. Such electronic units are freqently difficult to program, and are sometimes cumbersome and costly. Accordingly, if makes them impractical to use as disposable alerting devices in conjunction with specific containers of medicine.

OBJECTS AND ADVANTAGES

The present invention makes it possible for the prescriber of a medicine to not only designate the intervals that a medicine should be taken or used, but also include a practical reminder device. This device could be referred to as an "electronic attendant" sending pre-programmed signals of utmost importance.

The ability to produce this invention is the result, as readily recognized, of the tremendous advance in technology within the last few years. In years past, the likelihood of creating such a device was realistically impractical. At the present time however, it is feasible. Such a device can be virtually any size, shape, capable of emitting any number of signals, and at the same time it can be cost effective. Due to the fact that the creation of such an invention is now possible, it world-wide use would contribute to the welfare of those millions of persons using medicines.

One of the many ways of transmitting and controlling the proper intervals of using a medicine, would emanate from the instructions of a doctor in conjunction with the writing of a prescription.

Devices, of course, could be included as an integral part of pre-packaged medicines—both solids and liquids. The manufacturer could easily and conventiently program the devices in accordance with their recommended time periods. Such inclusions would result in a more desirable product because of the simplification and effectiveness in its use.

As previously mentioned, the majority of persons using medicines requiring adhering to specific time periods, encounter difficulties in determining when such time periods occur. This casual and random approach results in a great deal of "checking the clock" and lapses of memory. It also introduces the element of uneasiness and the anxiety associated with "another missed dose".

Although often overlooked, the necessity of administering medicines to animals is of tremendous importance. There could be many ways of effectively utilizing the present invention. One possible arrangement could be the placement of the containers of medicine in one area. This area could be near an employee who is working in a certain location. The employee would then be alerted by the devices affixed to the various containers.

DRAWINGS

FIG. 1. A container of medicine complete with cap and affixed device for alerting users of medicine.

FIG. 2. A cap for a container of medicine.

FIG. 3. A device for alerting users of medicine.

DRAWING REFERENCE NUMERALS

1. Mode Regulator
2. Display Screen
3. Set Regulator
4. Container
5. Cap

OPERATION OF INVENTION

When the mode regulator (1) is pushed in to operates the display screen (2) will begin to flash time intervals. The display screen (2) will show once daily, twice daily, three times daily, etc.

When the prescribed interval is flashed on the display screen (2) the set regulator (3) will be pushed in, setting the exact time when the medicine needs to be used. As time elapses, the display screen (2) will light up. An alarm will sound, making one aware of the time the medicine is to be used. The display screen (2) can also be used to display other vital information.

The present invention has been described and explained in the context of its present operation and various applications. Nevertheless, future utilization of the device would in all probability reveal other details not herewith envisioned. Consequently, the present description should not be construed if a limited sense.

I claim:

1. A device specifically designed and programmed to make one aware of predetermined sequential times a prescribed medicine in a particular container of medicine is to be used, the device dedicated to the container of medicine, said device abandoned when said container of medicine is abandoned, said device having a screen displaying time intervals programmed, said device adjustable for predetermined intervals using only a mode regulator button and a set regulator button, such that when the mode regulator button is pushed, the display screen begins to flash a plurality of time intervals, and when the prescribed interval is flashed on the display screen, the set regulator button is pushed to set the time when the medicine needs to be used, wherein said device emits audible and/or visible signals when said set time has elapsed.

2. The device specifically designed and programmed to make one aware of predetermined sequential times a prescribed medicine in a particular container of medicine is to be used according to claim 1 wherein said device is affixed to a cap of a container of medicine.

* * * * *